US008052387B2

(12) United States Patent
Xu

(10) Patent No.: US 8,052,387 B2
(45) Date of Patent: Nov. 8, 2011

(54) COOLING FAN

(75) Inventor: Hong-Bo Xu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 999 days.

(21) Appl. No.: 11/955,312

(22) Filed: Dec. 12, 2007

(65) Prior Publication Data

US 2009/0155087 A1 Jun. 18, 2009

(51) Int. Cl.
*B63H 1/26* (2006.01)

(52) U.S. Cl. ..... 416/5; 416/61; 416/241 R; 416/241 A

(58) Field of Classification Search ..... 416/5, 61, 416/241 R, 241 A
See application file for complete search history.

(56) References Cited

U.S. PATENT DOCUMENTS

| | | | | |
|---|---|---|---|---|
| 2,701,540 | A * | 2/1955 | Hamilton | 416/61 |
| 5,082,422 | A * | 1/1992 | Wang | 416/5 |
| 5,205,636 | A * | 4/1993 | Carpenter | 362/84 |
| 5,437,540 | A * | 8/1995 | Blocker et al. | 416/5 |
| 6,082,868 | A * | 7/2000 | Carpenter | 416/5 |
| 6,327,994 | B1 * | 12/2001 | Labrador | 114/382 |
| 6,623,243 | B1 * | 9/2003 | Hodos | 416/61 |
| 2005/0141997 | A1 * | 6/2005 | Rast | 416/229 R |

* cited by examiner

*Primary Examiner* — Igor Kershteyn
(74) *Attorney, Agent, or Firm* — Altis Law Group, Inc.

(57) ABSTRACT

A cooling fan includes a hub (40) and blades (50) extending radially from the hub. Each of the blades is divided into strip zones (505, 51, 52, 53, 54, 55, 56), projections of homocentric arcs concentric with the hub on the blades are defined as boundaries of the zones. The zones are coated with a layer of paint with different colors to present a rainbow-liked image when the fan is in operation.

17 Claims, 4 Drawing Sheets

COOLING FAN

BACKGROUND OF THE INVENTION

1. Field of the Invention

The present invention relates to a cooling fan, and more particularly to a cooling fan having a fantastic visual effect when the fan is in operation.

2. Description of Related Art

Nowadays, cooling fans are commonly used in many fields such as heat dissipation device for CPUs in computers. With the fast and prosperous development of computer and information technologies, designs related to computers, typically for cooling fans are continuously updated. The demands upon cooling fans are no longer limited to rigid, invariable structures.

Typically, a cooling fan used for cooling CPUs in a computer includes a housing and a rotor received in the housing. A plurality of light emitting diodes with different colors is arranged on the housing. When the rotor rotates, the light emitting diodes project lights with different colors to the rotor. Thus, a special visual effect is provided when the cooling fan is in operation. However, the cooling fan with light emitting diodes has a complex structure, which increasing the cost of the cooling fan. Furthermore, the light projected by the light emitting diodes is so glare that may be a light contamination.

What is needed, therefore, is an improved cooling fan which can overcome the above problems.

SUMMARY OF THE INVENTION

A cooling fan includes a hub and a plurality of blades extending radially from the hub. Each of the blades is divided into a plurality of strip zones, and projections of a plurality of homocentric arcs concentric with the hub on the blades are defined as boundaries of the zones. The zones are coated with a layer of paint with different colors to present a rainbow-liked image when the fan is in operation.

Other advantages and novel features of the present cooling fan will become more apparent from the following detailed description when taken in conjunction with the accompanying drawings, in which:

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the present cooling fan. Moreover, in the drawings, like reference numerals designate corresponding parts throughout the several views.

DETAILED DESCRIPTION OF THE INVENTION

Figure 1:
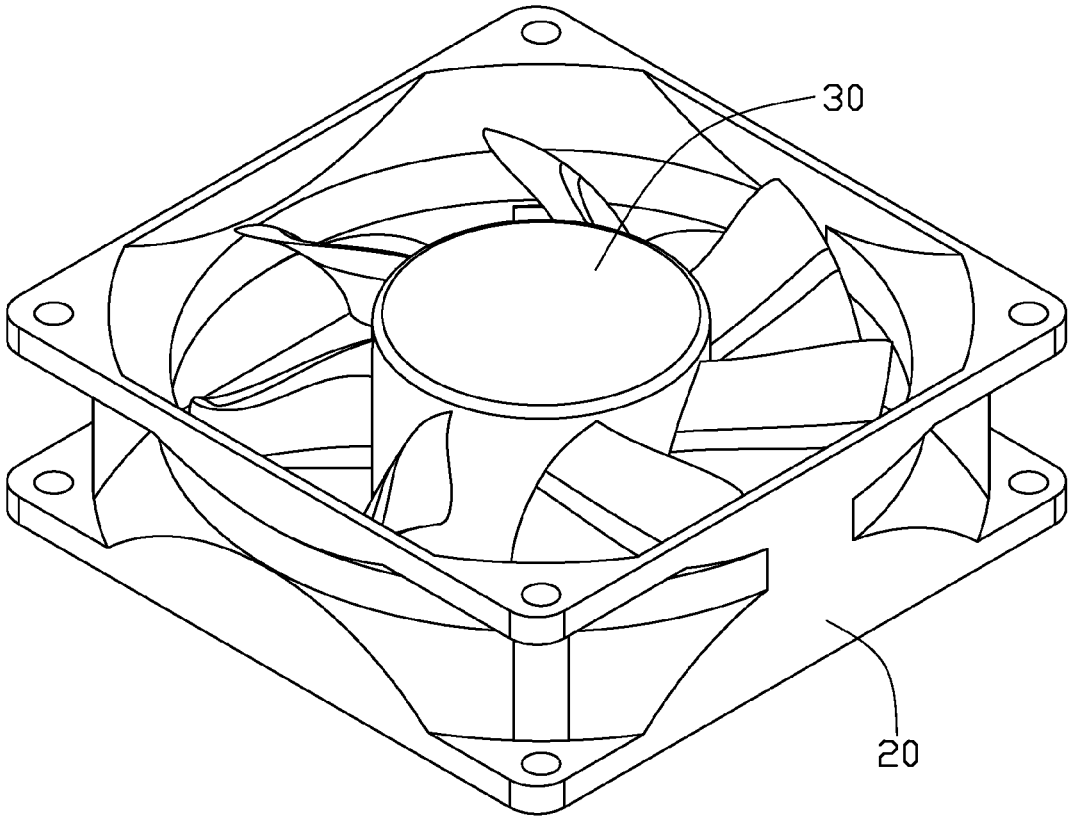
FIG. 1 is an assembled, isometric view of a cooling fan, in accordance with a first preferred embodiment of the present invention.
Figure 2:
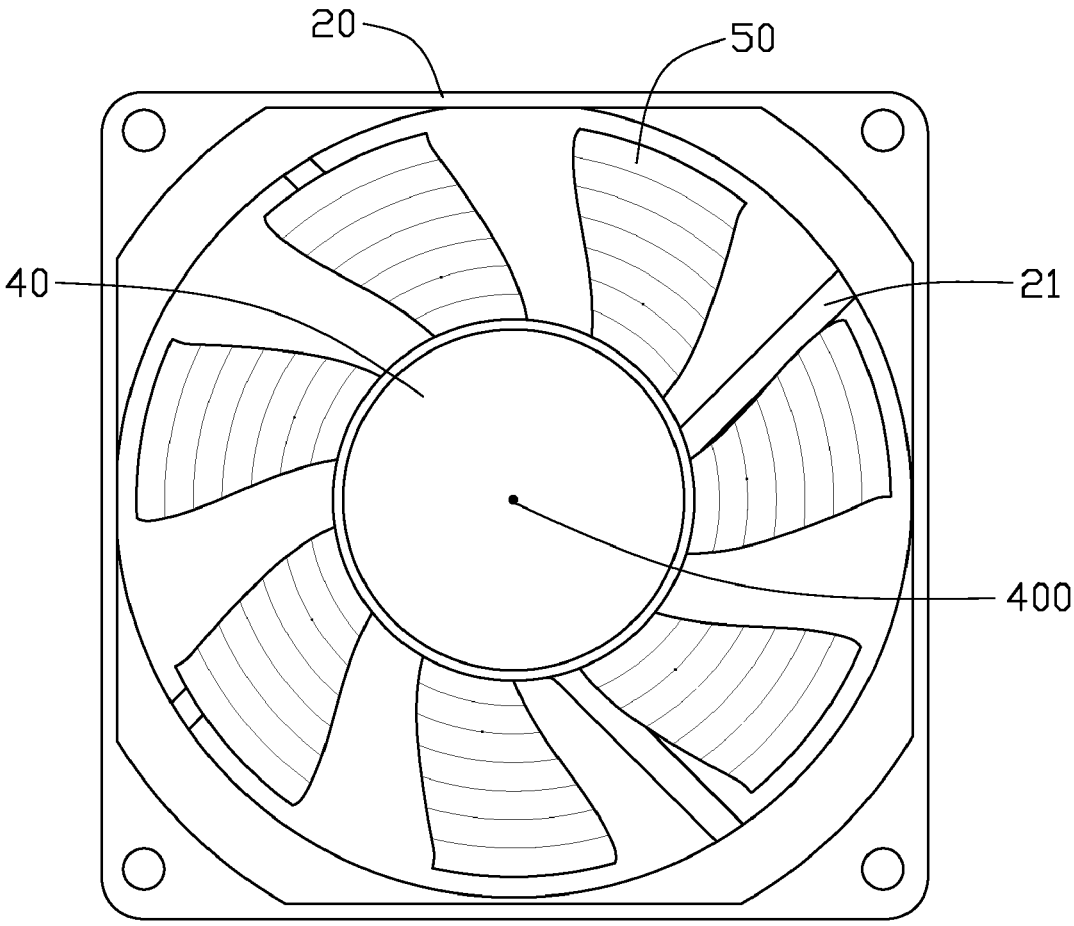
FIG. 2 is a top plan view of the cooling fan of FIG. 1.
Figure 3:
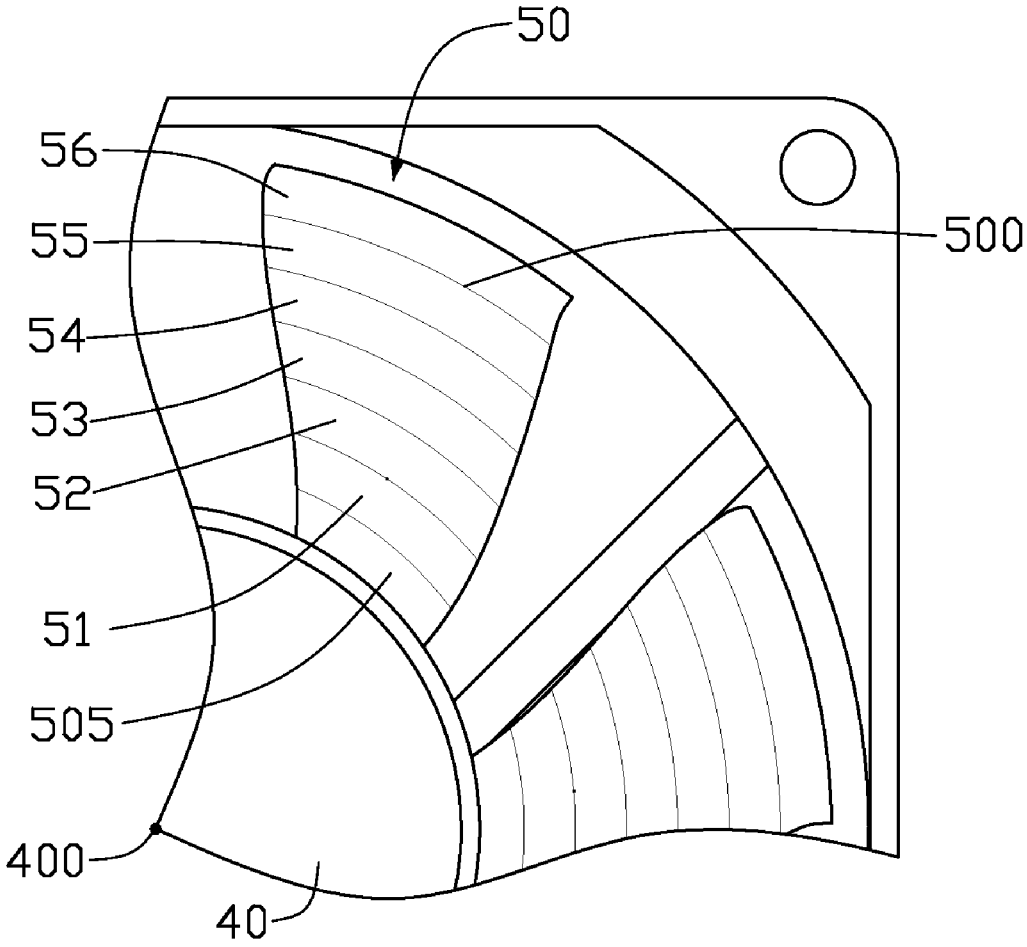
FIG. 3 is a partial enlarged view of the cooling fan of FIG. 2.

Referring to FIGS. 1-3, a cooling fan in accordance with a first preferred embodiment of the invention is shown. The fan comprises a housing 20 and a rotor 30 received in the housing 20. In this embodiment, the cooling fan is used in a computer for dissipating heat generating electronic elements such as CPUs. Understandably, the present invention can be other types of cooling fans.

The housing 20 is approximately square-shaped with a cylindrical receiving space defined therein for receiving the rotor 30 and a stator (not shown) of the fan. A supporting base (not shown) is arranged in a bottom side of the housing 20. Four ribs 21 connect the housing 20 and the supporting base. The rotor 30 and the stator of the fan are received in the housing 20 and mounted to the supporting base.

The rotor 30 comprises a cylindrical hub 40 and a plurality of blades 50 extending radially from an outer periphery of the hub 40. Each of the blades 50 is divided into seven strip zones 505, 51, 52, 53, 54, 55, 56. Boundaries 500 among the strip zones 505, 51, 52, 53, 54, 55, 56 are projections of a plurality of homocentric arcs concentric with a center 400 of the hub 40. Each of the zones 505, 51, 52, 53, 54, 55, 56 has a radial width equal to that of each other zone 51, 52, 53, 54, 55, 56, 505. The zones 505, 51, 52, 53, 54, 55, 56 are arranged on each of the blades 50 in series along a radial direction. The zone 505 is the nearest zone to the hub 40, and the zone 56 is the furthest zone from the hub 40. The zone 505 is near the outer periphery of the hub 40.

A layer of paint with different colors is coated on a top surface of each of the blades 50. Specifically, the color of the layer of paint on the zone 51 is purple, the color of the layer of paint on the zone 52 is blue, the color of the layer of paint on the zone 53 is green, the color of the layer of paint on the zone 54 is yellow, the color of the layer of paint on the zone 55 is orange, and the color of the layer of paint on the zone 56 is red. The zone 505 retains its original appearance without any colored layer of paint coated thereon. In other words, the colors of the layer of paint on each of the blades 50 are arranged in an order like a rainbow which contains purple, blue, green, yellow, orange and red. The layer of paint can be made of fluorescent material which is painted on the surface of the blades 50. Alternatively, the layer of paint can be a painted polymeric film which is adhered to the surfaces of the blades 50.

When the fan is in operation, as the blades 50 rotate rapidly, the layer of paint on the blades 50 form a ring-shaped colorful image, which looks like a rainbow. Thus, a fantastic visual effect is present in a top plan view of the fan by the layer of paint on the blades 50. As the zone 505 is uncoated, and the inner side of the zone 51 is spaced apart from the outer periphery of the hub 40, the rainbow-liked image will be presented completely, and will not be interfered with by the rotating outer periphery of the hub 40.

The blades 50 can be made of transparent or translucent material. Thereby, the layer of paint on the top surface of the blades 50 can be seen in a bottom view of the fan, and the rainbow-liked image can also be seen at a bottom side of the fan when the fan is in operation.

Figure 4:
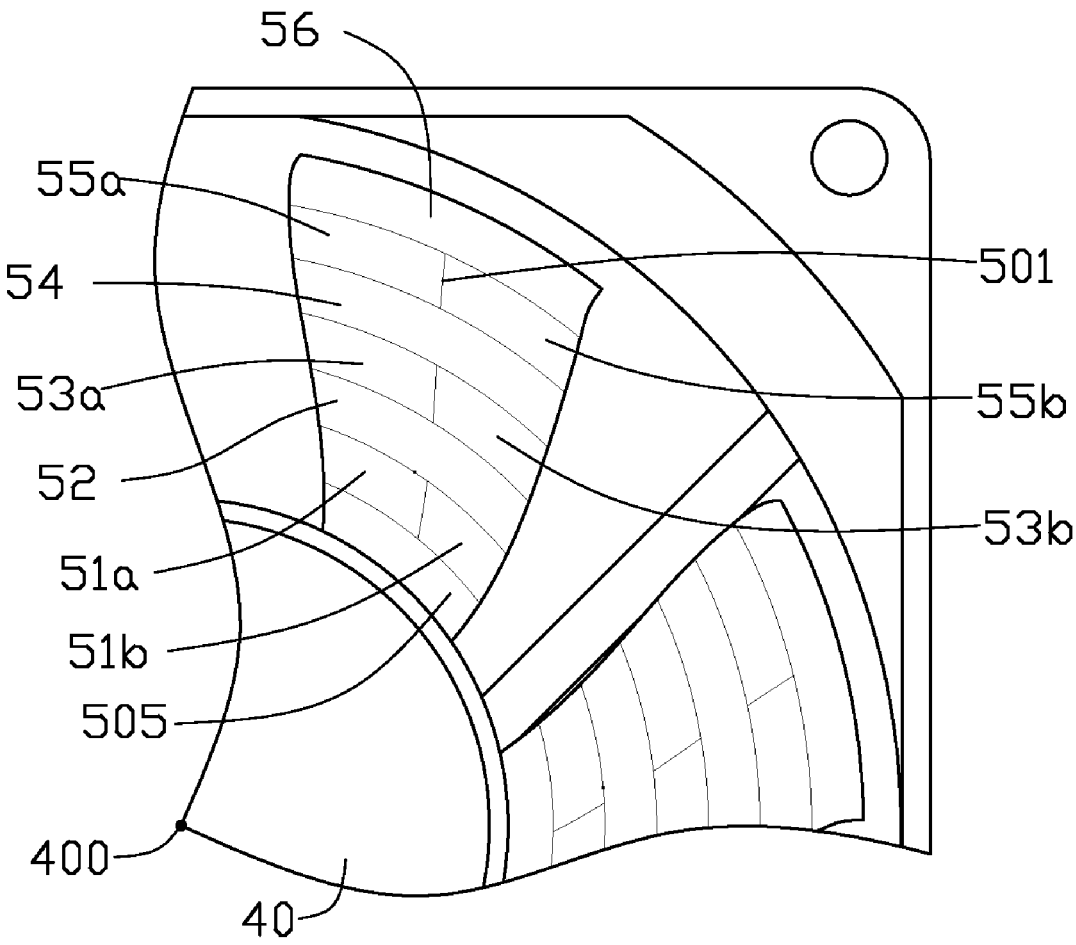
FIG. 4 is a partial enlarged view of a cooling fan in accordance with a second preferred embodiment of the present invention.

FIG. 4 shows a second embodiment of a cooling fan according to the present invention. Compared with the first embodiment, each of the blades 50 is divided into ten strip zones 505, 51*a*, 51*b*, 52, 53*a*, 53*b*, 54, 55*a*, 55*b*, 56. The zone 51 in the first embodiment is replaced by two strip zones 51*a*, 51*b* arranged end to end. A size of the strip zone 51*a* is equal to that of the strip zone 51*b*. The zone 53 in the first embodiment is replaced by two strip zones 53*a*, 53*b* arranged end to end. A size of the strip zone 53*a* is equal to that of the strip zone 53*b*. The zone 55 in the first embodiment is replaced by two strip zones 55*a*, 55*b* arranged end to end. A size of the strip zone 55*a* is equal to that of the strip zone 55*b*. A boundary 501 between the zone 51*a* and 51*b*, between the zone 53*a* and 53*b*, and between the zone 55*a* and 55*b* is an angled radial line running along an extending direction of the blade 50 and located midway between two lateral flanges of the blade 50. The color of the layer of paint on the zone 51*a* is red, and the color of the layer of paint on the zone 51*b* is blue. The color of the layer of paint on the zone 53*a* is blue, and the color of the layer of paint on the zone 53*b* is yellow. The color of the layer of paint on the zone 55*a* is yellow, and the color of the layer of paint on the zone 55*b* is red. Other structures and characteristics of the fan of the second embodiment are the same as those of the fan of the first embodiment. Accordingly, a detailed description of such structures and characteristics is omitted here.

As is known, a color of red mixed with a color of yellow can obtain a color of orange, a color of yellow mixed with a color of blue can obtain a color of green, and a color of blue mixed with a color of red can obtain a color of purple. When the blades 50 rotate rapidly, the zone 51*a* having a red layer of paint cooperates with the zone 51*b* having a blue layer of paint in a same circumferential direction to present a color of purple, the zone 53*a* having a blue layer of paint cooperates with the zone 53*b* having a yellow layer of paint to present a color of green, and the zone 55*a* having a yellow layer of paint cooperates with the zone 55*b* having a red layer of paint to present a color of orange. Thus, the layer of paint on the surface of each of the blades 50 with three colors, i.e., red, yellow, and blue, can also provide a fantastic rainbow-liked image when the fan is in operation. Understandably, the colors of the layer of paint on the zones 51*a* and 51*b* can be interchanged with each other, the colors of the layer of paint on the zones 53*a* and 53*b* can be interchanged with each other, and the colors of the layer of paint on the zones 55*a* and 55*b* can be interchanged with each other.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A cooling fan, comprising a hub and a plurality of blades extending radially from the hub, each of the blades being divided into a plurality of strip zones, projections of a plurality of homocentric circles concentric with a center of the hub on the blades being defined as boundaries of the zones, all but one of the zones being coated with a layer of paint with different colors to present a rainbow-liked image when the fan is in operation;

wherein each of the blades is divided into first, second, third, fourth, fifth, sixth and seventh zones;

wherein the first zone is the nearest zone to the hub and is uncoated, and the seventh zone is the furthest zone from the hub; and wherein each of the second, fourth and sixth zones is divided into two parts by a radial line, the color of the layer of paint on the two parts of the second zone is red and blue, respectively, the color of the layer of paint on the two parts of the fourth zone is blue and yellow, respectively, the color of the layer of paint on the two parts of the sixth zone is yellow and red, respectively, and the color of the layer of paint on the third, fifth and seventh zones is blue, yellow and red, respectively.

2. The cooling fan as claimed in claim 1, wherein each of the second, fourth and sixth zones are divided into two even parts.

3. The cooling fan as claimed in claim 1, wherein a radial width of each of the zones is equal to each other.

4. The cooling fan as claimed in claim 1, wherein the layer of paint is made of fluorescent material.

5. The cooling fan as claimed in claim 1, wherein the layer of paint is a painted polymeric film.

6. The cooling fan as claimed in claim 1, wherein the layer of paint is coated on one surface of each of the blades.

7. The cooling fan as claimed in claim 1, wherein the blades are made of transparent or translucent material.

8. The cooling fan as claimed in claim 1, further comprising a housing for receiving the hub and the blades.

9. A cooling fan, comprising:

a frame; and a rotor received in the frame, the rotor having a hub and a plurality of blades extending radially from an outer periphery of the hub, each of the blades being divided into a plurality of zones coated with different colors;

wherein one of the zones is coated with two different colors of said different colors and another zone adjacent to the one of the zones is coated with a color of said different colors.

10. The cooling fan as claimed in claim 9, wherein the zones are arc-shaped strips.

11. The cooling fan as claimed in claim 10, wherein projections of the zones are segments of a plurality of homocentric rings concentric with a center of the hub.

12. The cooling fan as claimed in claim 9, wherein a radial width of each of the zones is equal to each other.

13. The cooling fan as claimed in claim 9, wherein the layer of paint is made of fluorescent material.

14. The cooling fan as claimed in claim 9, wherein the layer of paint is a painted polymeric film.

15. The cooling fan as claimed in claim 9, wherein the layer of paint is coated on one surface of each of the blades.

16. The cooling fan as claimed in claim 9, wherein the blades are made of transparent or translucent material.

17. The cooling fan as claimed in claim 9, further comprising a housing for receiving the hub and the blades.

* * * * *